US008881826B2

(12) United States Patent
Crome et al.

(10) Patent No.: US 8,881,826 B2
(45) Date of Patent: Nov. 11, 2014

(54) INSTALLATION FOR THE EXTRACTION OF FLUID FROM AN EXPANSE OF WATER, AND ASSOCIATED METHOD

(75) Inventors: Timothy John Crome, Asker (NO); Johan Kristian Boe, Oslo (NO); Igor Kopsov, Snayora (NO); Leiv Egelund, Billingstad (NO); Anil Kumar Sablok, Houston, TX (US); Manoj Ramachandran, Houston, TX (US)

(73) Assignee: Technip France (FR)

( * ) Notice: Subject to any disclaimer, the term of this patent is extended or adjusted under 35 U.S.C. 154(b) by 415 days.

(21) Appl. No.: 12/996,992

(22) PCT Filed: Jun. 9, 2009

(86) PCT No.: PCT/EP2009/057068

§ 371 (c)(1),
(2), (4) Date: May 10, 2011

(87) PCT Pub. No.: WO2009/150142

PCT Pub. Date: Dec. 17, 2009

(65) Prior Publication Data

US 2011/0209875 A1 Sep. 1, 2011

Related U.S. Application Data

(60) Provisional application No. 61/174,624, filed on May 1, 2009.

(30) Foreign Application Priority Data

Jun. 9, 2008 (FR) ..... 08 53808

(51) Int. Cl.

| | |
|---|---|
| ***E21B 43/01*** | (2006.01) |
| ***E21B 29/12*** | (2006.01) |
| ***B63B 21/50*** | (2006.01) |

(52) U.S. Cl.

CPC ..... *E21B 43/0107* (2013.01); *B63B 21/508* (2013.01)

USPC ..... 166/338; 166/339; 166/340; 166/341; 166/344; 166/345

(58) Field of Classification Search

USPC ..... 166/338, 340, 342, 344, 345, 350, 352, 166/353, 354; 405/200, 204–207, 209; 441/3–5

See application file for complete search history.

(56) References Cited

U.S. PATENT DOCUMENTS 3,474,749 A * 10/1969 Williamson ..... 114/264
4,199,275 A * 4/1980 Tuson ..... 405/195.1

(Continued)

FOREIGN PATENT DOCUMENTS

EP 1 849 701 10/2007
WO WO 93/24744 12/1993

*Primary Examiner* — James Sayre
(74) *Attorney, Agent, or Firm* — Ostrolenk Faber LLP

(57) ABSTRACT

This installation comprises an upper structure (12), and a flexible hose (16) capable of moving through the expanse of water (11 B) between an upper connected configuration and a lower disconnected configuration. The installation comprises a lower structure (14) having a base (60) extending at a distance from the bottom (11A) of the expanse of water (11 B). The upper structure (12) is capable of moving relative to the lower structure (14) between an extraction position and an evacuation position. The base (60) defines a passage (68) for travel of the flexible hose (16) as it moves between the upper connected configuration and the lower disconnected configuration and a stop (74) for retaining a connection head (92) of the hose (14), disposed in the travel passage (68), to keep the connection head (92) at a distance from the bottom (11A) of the expanse of water (11 B) in the lower disconnected configuration.

23 Claims, 8 Drawing Sheets

(56) References Cited

U.S. PATENT DOCUMENTS

| | | | | |
|---|---|---|---|---|
| 5,363,789 | A * | 11/1994 | Laurie et al. | 114/293 |
| 6,206,742 | B1 * | 3/2001 | Bull et al. | 441/1 |
| 6,595,725 | B1 * | 7/2003 | Shotbolt | 405/224.2 |
| 7,197,999 | B2 * | 4/2007 | Murray | 114/264 |
| 7,845,998 | B2 * | 12/2010 | Ramachandran et al. | 441/3 |
| 2007/0155259 | A1 * | 7/2007 | Van Tol et al. | 441/3 |
| 2010/0181074 | A1 * | 7/2010 | Millheim et al. | 166/350 |

* cited by examiner

INSTALLATION FOR THE EXTRACTION OF FLUID FROM AN EXPANSE OF WATER, AND ASSOCIATED METHOD

CROSS REFERENCE TO RELATED APPLICATIONS

The present application is a 35 U.S.C §371 National Phase conversion of PCT/EP2009/057068, filed Jun. 9, 2009, which claims benefit of French Application No. 08 053808, filed Jun. 9, 2008, and U.S. Provisional Application No. 61/174,624, filed May 1, 2009, the disclosures of which are incorporated herein by reference. The PCT International Application was published in the English language.

BACKGROUND OF THE INVENTION

The present invention relates to an installation for the extraction of fluid from an expanse of water, comprising:

- an upper structure extending at least in part above the surface of the expanse of water;
- at least one flexible hose extending through the expanse of water, the flexible hose comprising a head for connection to a collector placed on the upper structure, the flexible hose being capable of moving through the expanse of water between an upper configuration in which it is connected to the collector and a lower disconnected configuration.

An installation of this type generally comprises a floating structure such as a platform disposed above the expanse of water and a plurality of risers which connect the heads of wells located at the bottom of the expanse of water to the floating structure.

An installation of this type is intended, for example, for the extraction of deposits of hydrocarbons located under the bottom of an expanse of water such as a lake, a sea or an ocean, under conditions in which a stoppage of production and rapid safeguarding of the extraction installation may be required.

These conditions are encountered, in particular, in regions where the expanse of water is temporarily or permanently covered by a layer of ice, such as the polar regions, in particular the artic region.

In these regions, the layer of ice present at the surface of the expanse of water is relatively mobile. It can therefore partially damage the floating structure if said structure is anchored to the bottom of the expanse of water.

To overcome this problem, there are known installations equipped with ice-breakers which are set into rotation about the floating structure to keep the floating structure in an acceptable state for extraction.

It is also known to break the ice locally round the floating structure, for example by using a floating column-type platform with a median constriction, by vertically moving the floating structure to break the ice round the median constriction.

However, if the atmospheric conditions become too difficult or if a large-volume ice mass such as an iceberg moves towards the installation, this installation must be secured very quickly. Flexible hoses are accordingly disconnected at a distance from the floating structure, and the floating structure is moved from its extraction position to an evacuation position in safer waters.

These icebergs may have a very deep draft, e.g higher than 100 meters. When an iceberg is stuck in a layer of packed ice, it may be difficult to detect. Most of the time, it is not possible to change their route.

Under unfavorable weather conditions, the detection of icebergs is done by acoustic means, such as sonar. Due to the limited range of detection of sonars, an iceberg may be relatively close to the installation when it is positively detected. As a consequence, the installation must be able to perform an extremely quick disconnection of the risers, e.g. in fifteen minutes, to allow the upper floating structure to be moved away from the iceberg route. Moreover, once the iceberg is away from the installation, the reconnection of the risers must be fast and efficient to put back the installation into production in the shortest time possible.

For rapidly disconnecting flexible hoses at a distance from the floating structure, EP-A-1 849 701 for example discloses an installation of the aforementioned type comprising a shuttle formed by a riser top body which joins the connection heads of a plurality of flexible hoses.

The shuttle is mounted ejectably on a deck which externally extends the floating structure opposite and at a distance from the expanse of water. Under normal extraction conditions, the shuttle is fixed on the deck extending the structure and the flexible hoses are connected to collectors located on this deck.

In an emergency, the shuttle carrying the connection heads is ejected downwards from the deck and thus falls freely into the expanse of water, releasing the flexible hoses towards their disconnected configuration.

A solution of this type is partially satisfactory in quickly safeguarding the installation. However, there is a very high risk that the flexible hoses will be damaged during the descent.

Indeed, in EP-A-1 849 701, the shuttle carrying the connection heads drops in free fall until it reaches its equilibrium position in water, in which the buoyancy of the shuttle compensates its own weight, the weight of the risers hoses and the weight of the mooring lines.

When it free falls, the shuttle has a strong tendency to fall beyond its equilibrium depth and to oscillate vertically with strong amplitude before reaching equilibrium. Until the equilibrium position is reached, there is a strong risk of damaging the riser hoses, due to excessive bends, impact between different hoses, impact with mooring lines or with the bottom of the water expanse when the water depth is relatively low, e.g. in the range of 300 to 400 m.

Moreover, the shuttle will be difficult to locate, once disconnected, and this can delay the return to operation of the installation. Strong lifting means may be necessary to lift back the shuttle to its reconnection position near the surface, since this position is quite far up from the equilibrium position.

The overall weight of the assembly formed by the mooring lines, the flexible hoses and the shuttle is high which necessitates a corresponding dimensioning of the upper floating structure, hence increasing manufacturing and settling costs of the installation.

WO 93/24733 discloses an installation comprising a floating vessel connected with releasable means to a floating turret. The floating turret is located very close to the surface to be inserted in a moon pool of the floating vessel when the upper vessel is connected.

In case an iceberg threatens the installation, the vessel can be disconnected and moved rapidly away from the turret. However, once disconnected from the vessel, the turret floats nears the surface and thus may be impacted by icebergs.

SUMMARY OF THE INVENTION

It is an object of the invention to provide a fluid extracting installation which can be safeguarded very quickly by disconnection of the flexible extraction hoses, the installation being able to be put back into production easily and in the quickest possible time.

It is another object of the invention to provide a fluid extracting installation able to be operated safely in an area in which icebergs with deep drafts are susceptible to be drifting in the water.

The invention accordingly relates to an installation of the aforementioned type, characterized in that the installation comprises:

a lower structure which is completely immersed in the expanse of water and has a base extending at a distance from the bottom of the expanse of water and means for holding the base in position relative to the bottom of the expanse of water, the upper structure being capable of moving relative to the lower structure between an extraction position located substantially opposite and above the lower structure and an evacuation position located at a distance from the lower structure, the base defining, for the or each flexible hose, at least a passage for the travel of the flexible hose as it moves between the upper connected configuration and the lower disconnected configuration and at least a stop for retaining the connection head, the stop being disposed in the travel passage, to keep the connection head at a distance from the bottom of the expanse of water in the lower disconnected configuration.

The installation according to the invention can comprise one or more of the following characteristics, in isolation or in any technically possible combination:

the base floats above the bottom of the expanse of water at least when the upper structure occupies its evacuation position and when the flexible hose occupies its lower disconnected configuration;

the base is mounted in a rigidly fixed manner on the bottom of the expanse of water by means of at least one rigid fixing element placed on the bottom of the expanse of water;

the installation comprises a plurality of flexible hoses, the base defining, for each flexible hose, an individual passage for the travel of the flexible hose receiving a single flexible hose, the flexible hoses being capable of moving independently of one another between the upper connected configuration and the lower disconnected configuration;

it comprises a plurality of flexible hoses, each flexible hose having a connection head for connection to a collector placed on the upper structure, the installation comprising a common member for linking the connection heads of each flexible hose to jointly move the connection heads of each flexible hose as each flexible hose passes between the upper connected configuration and the lower disconnected configuration;

it comprises means for guiding the flexible hose between its upper connected configuration and its lower disconnected configuration, the guide means extending between a first point located on the upper structure and a second point located on the lower structure when the upper structure occupies its extraction position;

the guide means comprise a guide integral with the lower structure and the upper structure and a guided member integral with the flexible hose, the guided member being mounted so as to slide relative to the guide as the flexible hose passes between the upper connected configuration and the lower disconnected configuration;

the guide comprises a guide tube which includes an upper portion integral with the upper structure and a lower portion integral with the lower structure, the guided member being mounted so as to slide in the guide tube;

the guide tube has an upper region at a distance from the retaining stop, the upper region having a first cross-section, and the guide tube has a lower region located in the vicinity of the retaining stop and having a second cross-section smaller than the first cross-section;

the guide comprises at least a guide line integral, on the one hand, with the upper structure and, on the other hand, with the lower structure, the guided member being mounted so as to slide round the guide line;

the or each collector is permanently disposed in a delimited volume of gas on the upper structure when the upper structure occupies its extraction position, the retaining stop being disposed in a volume of liquid immersed in the expanse of water ;

it comprises at least one arch disposed in the vicinity of the lower structure, the flexible hose being engaged over the arch so as to have a wave-shaped run at one outlet of the travel passage;

the arch is carried by the lower structure; and the arch is independent of the lower structure, the arch comprising a buoy and means for anchoring the buoy at the bottom of the expanse of water;

the base defines an upper surface for securing the upper structure the upper surface being placed at a depth greater than 150 m at least in the extraction position and in the evacuation position;

the upper structure comprises a surface installation and a floating column having a generally tubular shape disposed below the surface installation and partially immersed in the expanse of water;

the floating column has an upper portion disposed above the surface of the expanse of water and a lower portion immersed below the expanse of water, the height of the immersed lower portion being at least twice as great as the height of the upper portion;

the floating column further delimits, in the lower portion a plurality of flotation compartments capable of being filled selectively with water or gas, to control the buoyancy of the upper structure.

The invention also relates to a method for disconnecting an installation for the extraction of fluid, characterized in that it comprises the following steps:

holding an extraction installation as defined above in an expanse of water, the flexible hose being disposed, in its upper connected configuration, on the collector integral with the upper structure, the upper structure occupying its extraction position;

disconnecting the connection head of the flexible hose, at a distance from the collector;

passing the flexible hose from its upper connection configuration to its lower disconnected configuration, the flexible hose traveling through the travel passage in the lower structure;

immobilizing the connection head against the receiving stop to immobilize the connection head on the lower structure at a distance from the bottom of the expanse of water;

moving the upper structure relative to the lower structure from its extraction position to its evacuation position.

More generally the invention relates to an installation for extracting fluid from an expanse of water, comprising:

an upper structure extending at least in part above the surface of the expanse of water;

at least one flexible hose extending through the expanse of water, the flexible hose comprising a head for connection to a collector placed on the upper structure, the flexible hose being capable of moving through the expanse of water between an upper configuration in which it is connected to the collector and a lower disconnected configuration, the installation comprising means for guiding the flexible hose between its upper configuration connected to the collector and its lower disconnected configuration, the guide means comprising a guide integral with the upper structure and a guided member integral with the flexible hose, the guided member being mounted so as to slide relative to the guide as the flexible hose passes between the upper connected configuration and the lower disconnected configuration, the guide extending between a first point located permanently in the gas volume delimited by the upper structure round the collector and a second point immersed in the expanse of water.

An installation of this type can thus be free of a lower structure, the guide being located, at its lower end, at the level of the lowest surface of the upper structure, or projecting downwards from the lowest surface.

The upper end of the guide is advantageously located above the surface of the expanse of water.

This installation can also comprise one or more of the characteristics listed above

BRIEF DESCRIPTION OF THE DRAWINGS

The invention will be understood better on reading the following description which is given merely by way of example and with reference to the accompanying drawings, in which.

DESCRIPTION OF PREFERRED EMBODIMENTS

Figure 1:
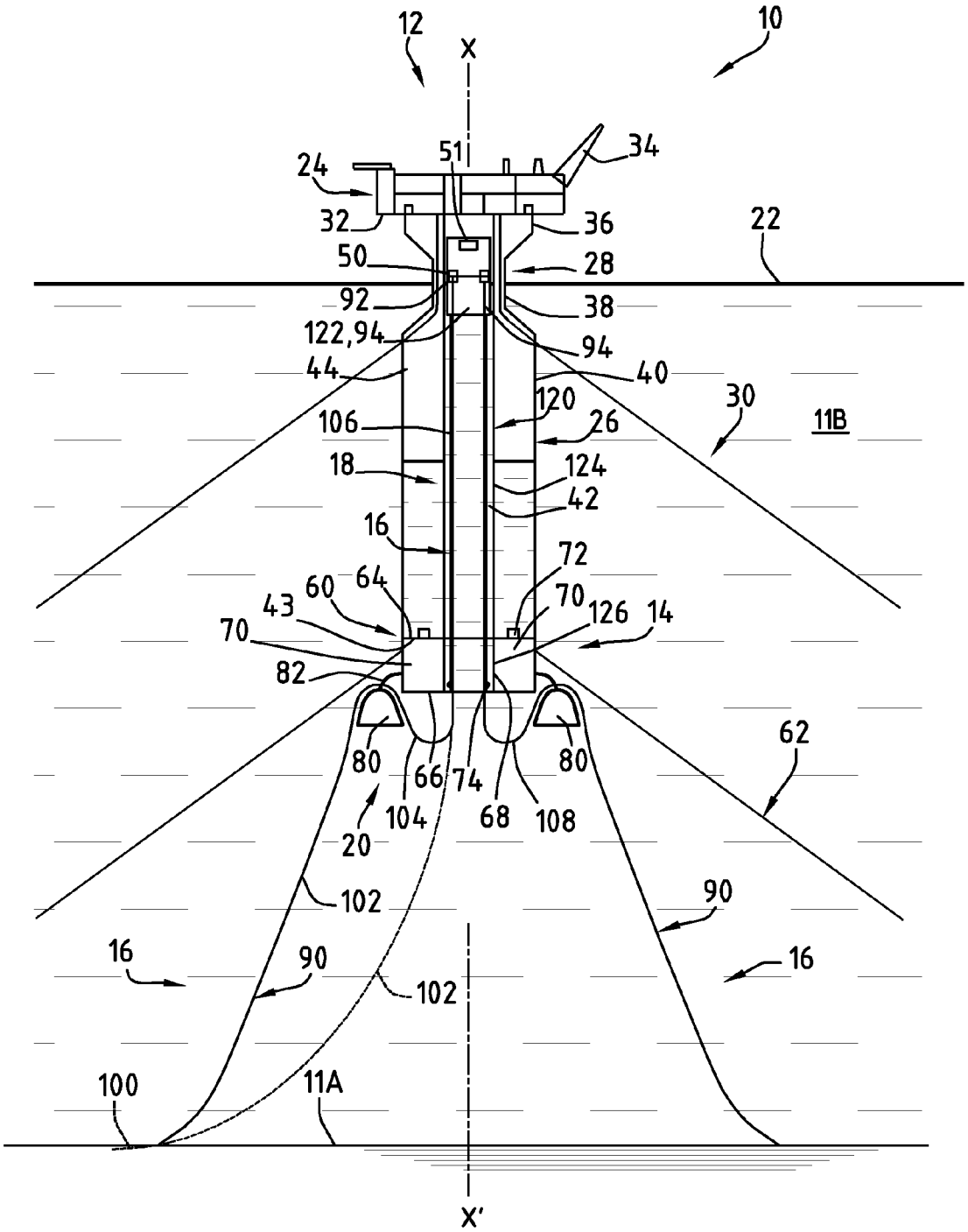
FIG. 1 is a schematic partial section through a median vertical plane of a first fluid extracting installation according to the invention, the flexible extraction hoses occupying the configuration in which they are connected to the upper structure.

FIGS. 1 to 4 show a first fluid extraction installation 10 according to the invention. This installation 10 is intended for example for the extraction of liquid or gaseous hydrocarbons located below the bottom 11A of an expanse of water 11B.

As illustrated in the figures, this installation 10 comprises a floating upper structure 12 which, in an emergency, can be moved between an extraction position and an evacuation position, and a lower structure 14 which is held in position relative to the bottom 11A when the structure 12 is moved towards its evacuation position.

The installation further comprises a plurality of flexible extraction hoses 16 extending from the bottom 11A of the expanse of water 11 B through the lower structure 14 and the upper structure 12, the flexible hoses 16 being movable between an upper configuration in which they are connected to the upper structure 12 and a lower disconnected configuration, in which they are held so as to rest in the lower structure 14.

The installation 10 additionally comprises means 18 for guiding the flexible hoses 16 through the upper structure 12 and through the lower structure 14 between their connected configuration and their disconnected configuration and means 20 for shaping each flexible hose 16 below the lower structure 14.

The expanse of water 11 B is, for example, a lake, a sea or an ocean. The installation rests on the bottom 11 A of the expanse of water 11 B and has a depth, between the surface 22 and the bottom 11 A, of for example between 300 m and 3000 m. The surface 22 of expanse of water 11 B may be covered by a surface layer of ice.

In the example shown in FIG. 1, the upper structure 12 and the lower structure 14 form two portions of a floating platform of the "rising column" type, which is partially immersed in the expanse of water 11B, commonly known by the acronym SPAR.

In a variation, the upper structure 12 is a floating barge for the production, liquefaction, storage and unloading of liquefied hydrocarbons (known as a floating production storage and offloading unit or FPSO), placed in the vicinity of a hydrocarbon production site in the open sea.

In a further variation, the upper structure 12 is a floating storage and regas unit or FRSU, or else a semi-submersible platform such as, for example, an extended draft semi-submersible platform or EDP.

Referring to FIG. 1, the upper structure 12 comprises, from top to bottom in the figure, a surface installation 24 disposed above the surface 22 of the expanse of water 11 B and a floating column 26 disposed below the surface installation 24 and partially immersed in the expanse of water 11B.

The upper structure 12 further comprises a flexible hose 16 connection station 28 disposed on a dry surface in a volume of gas, and flexible upper lines 30 for temporarily anchoring the upper structure 12 to the bottom 11A of the expanse of water 11B.

The surface installation 24 includes a deck 32, which is disposed above the column 26 and carries surface equipment such as cranes 34.

The column 26 has a generally tubular shape with a vertical axis X-X'. It has an upper portion 36 disposed above the surface 22 of the expanse of water, an intermediate portion 38 delimiting an annular constriction and a lower portion 40 immersed below the expanse of water.

The height of the immersed lower portion 40 is much greater than the height of the upper portion 36, taken along the vertical axis X-X', for example at least twice as great as this height.

The column 26 defines, below the connection station 28, at least an upper central passage 42 with the axis X-X'.

The passage 42 opens upwards opposite the connection station 28 and opens downwards in a lower surface 43 of the column 26 located axially opposite the lower structure 14, when the upper structure 12 is disposed in its extraction position above the structure 14.

The central passage 42 is at least partially filled with water.

The column 26 further delimits, in the lower portion 40 round the central passage 42, a plurality of flotation compartments 44 capable of being filled selectively with water or gas, to control the buoyancy of the upper structure 12.

The ballasting of the compartments 44 with water reduces the buoyancy of the structure 12 and causes the descent and immersion of a great height of the column 26. The injection of gas into the compartments 44 increases the buoyancy of the structure 12 and causes the ascent of the column 26 relative to the surface of the expanse of water 11B.

It is thus possible to move the intermediate constriction portion 28 vertically upwards or downwards relative to the surface 22 of the expanse of water, and, if necessary, break the layer of ice which may be present on the surface 22.

As mentioned hereinbefore, the connection station 28 is disposed in a volume of gas within the column 26.

In the example shown in FIG. 1, the connection station 28 is disposed in the intermediate portion 38 above the surface 22 of the expanse of water. In a variation, the station 28 is disposed below the surface 22 of the expanse of water 11B, but it is isolated in a sealed manner from the expanse of water 11B so as to remain dry in a volume of gas.

Figure 2:
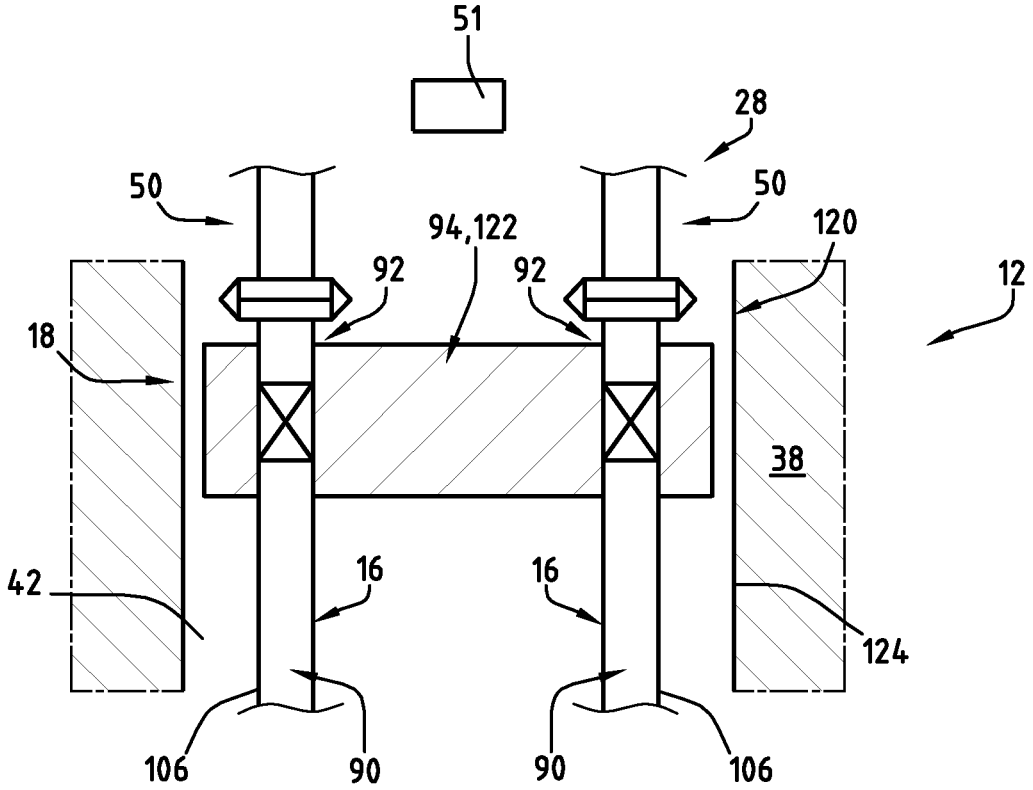
FIG. 2 is a schematic view of a detail of a connection station of the installation of FIG. 1, in the connected configuration of the flexible hoses.
Figure 3:
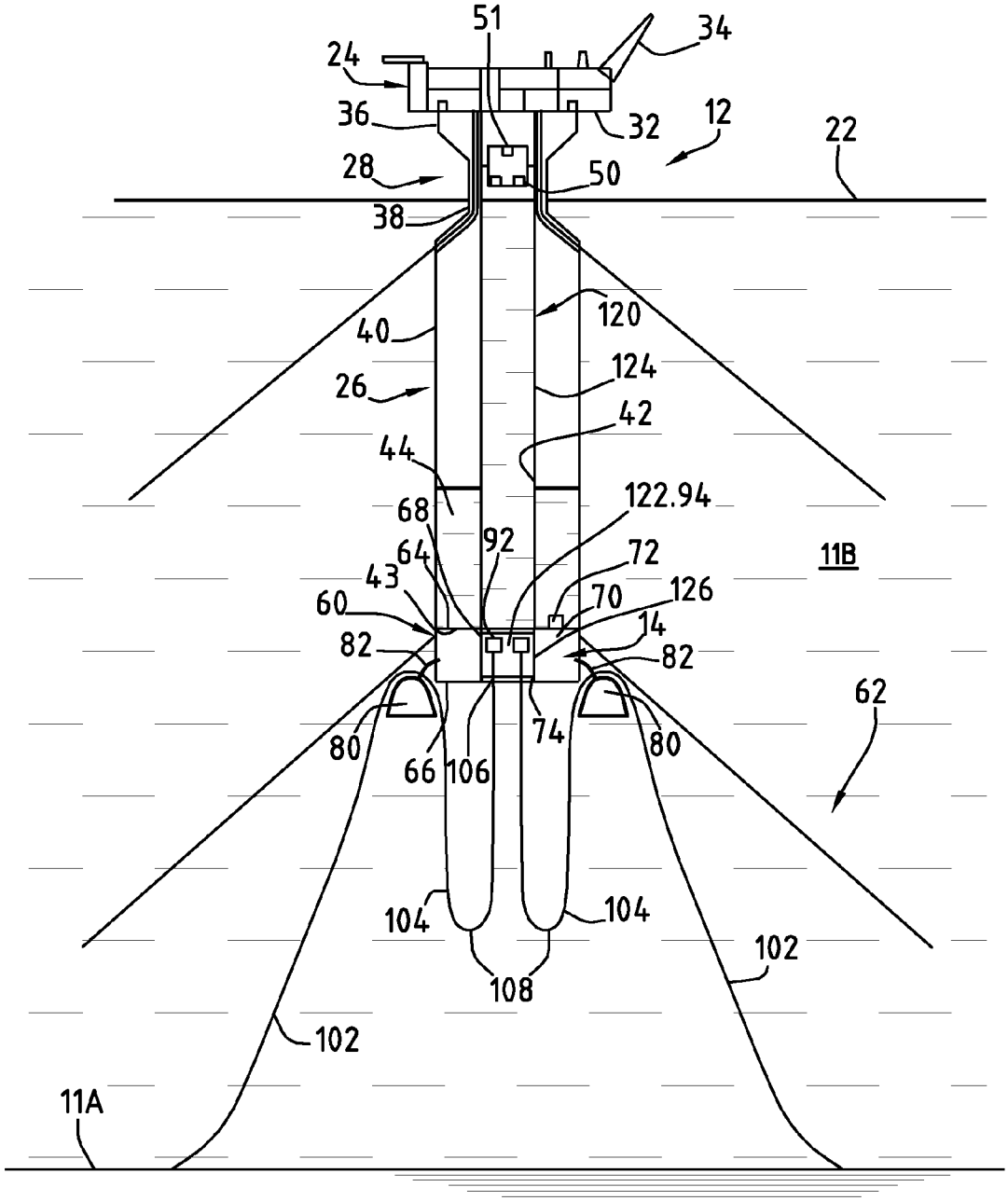
FIG. 3 is a view similar to FIG. 1 during the passage of the flexible hoses from the configuration in which they are connected to the upper structure to their disconnected configuration abutting against the lower structure.

As illustrated in FIG. 2, the station 28 comprises a plurality of connection collectors 50 for a flexible hose 16, the collectors being disposed in the volume of gas, and a winch 51 for manipulating the hoses 16 in order to reconnect the hoses 16 to the collectors 50 in the connection station 28.

The collectors 50 are generally known as manifolds.

In the conventional manner, each collector 50 is equipped with a valve which selectively blocks the passage of fluid through the collector 50 and is connected for example to a fluid reservoir located on the structure 12, or to a unit for the treatment and/or distribution of fluid to surface ships.

The upper anchor lines 30 are fixed, at their upper end, to the upper portion 36 of the column 26. They are deployed from the upper portion 36 towards the bottom 11A of the expanse of water 11B. They comprise, at their lower end, a means for anchoring (not shown) to the bottom 11A of the expanse of water 11B.

The upper anchor lines 30 are capable of keeping the upper structure 12 completely immobile relative to the bottom 11A of the expanse of water in the extraction position. They can be retracted on the column 26 or cut in an emergency to allow the upper structure 12 to move towards its evacuation position.

The term "completely immobile" means that the upper structure 12 is capable of lateral movements, relative to its equilibrium position, having a maximum range of less than 15% of the depth of water.

The lower structure 14 comprises a floating base 60, disposed at a distance from and above the bottom 11A of the expanse of water 11B, and lower flexible lines 62 for anchoring the base 60 to the bottom 11A of the expanse of water 11B.

In the example shown in FIGS. 1 to 4, the base 60 has a tubular shape of axis X-X' and a horizontal section which is substantially conjugate to that of the lower portion 40.

The base 60 defines an upper surface 64 for securing the upper structure 12, a lower surface 66 intended to be disposed opposite and at a distance from the bottom 11A of the expanse of water 11B, and a lower central passage 68 for travel of the flexible hoses 16 and opening into the upper surface 64 and lower surface 66.

The base 60 further defines, round the lower central passage 68, lower flotation compartments 70 which are intended to be filled at least in part with gas.

The base 60 is completely immersed in the expanse of water 11B. Its upper surface 64 is always placed at an adequate depth, for example of greater than 150 m, to allow the passage of floating objects such as icebergs above the lower structure 14, without the risk of a collision.

In the example shown in FIGS. 1 to 4, the upper surface 64 is intended to support the lower surface 43 of the upper structure 12 when the upper structure 12 occupies its extraction position. The upper surface 64 carries releasable means 72 for fixing the upper structure 12 on the lower structure 14.

The lower central passage 68 extends along the axis X-X' in the axial extension of the upper central passage 42 when the upper structure 12 occupies its extraction position. It has a substantially closed contour over at least a horizontal section. The central passage 68 is completely filled with water.

The base 60 further comprises, in the lower central passage 68, a retaining stop 74 for retaining the flexible hoses 16, as will be seen hereinafter. The retaining stop 74 projects transversely to the axis X-X' in the passage 68.

The compartments 70 give the structure 14 inherent buoyancy. As will be seen hereinafter, the lower structure 14 floats spontaneously at a distance from the bottom 11A of the expanse of water 11B, especially when the upper structure 12 is disposed in its evacuation position, at a distance from lower structure 14, and when the flexible hoses 16 are supported by the lower structure 14.

The lower anchor lines 62 are fixed to the base 60 at their upper ends, and are fixed at the bottom 11A of the expanse of water at their lower ends by anchor means (not shown).

The lines 62 prevent significant horizontal movement of the lower structure 14 in a horizontal plane. The term "significant horizontal movement" denotes a movement over a distance at least equal to 15% of the depth of water.

Figure 4:
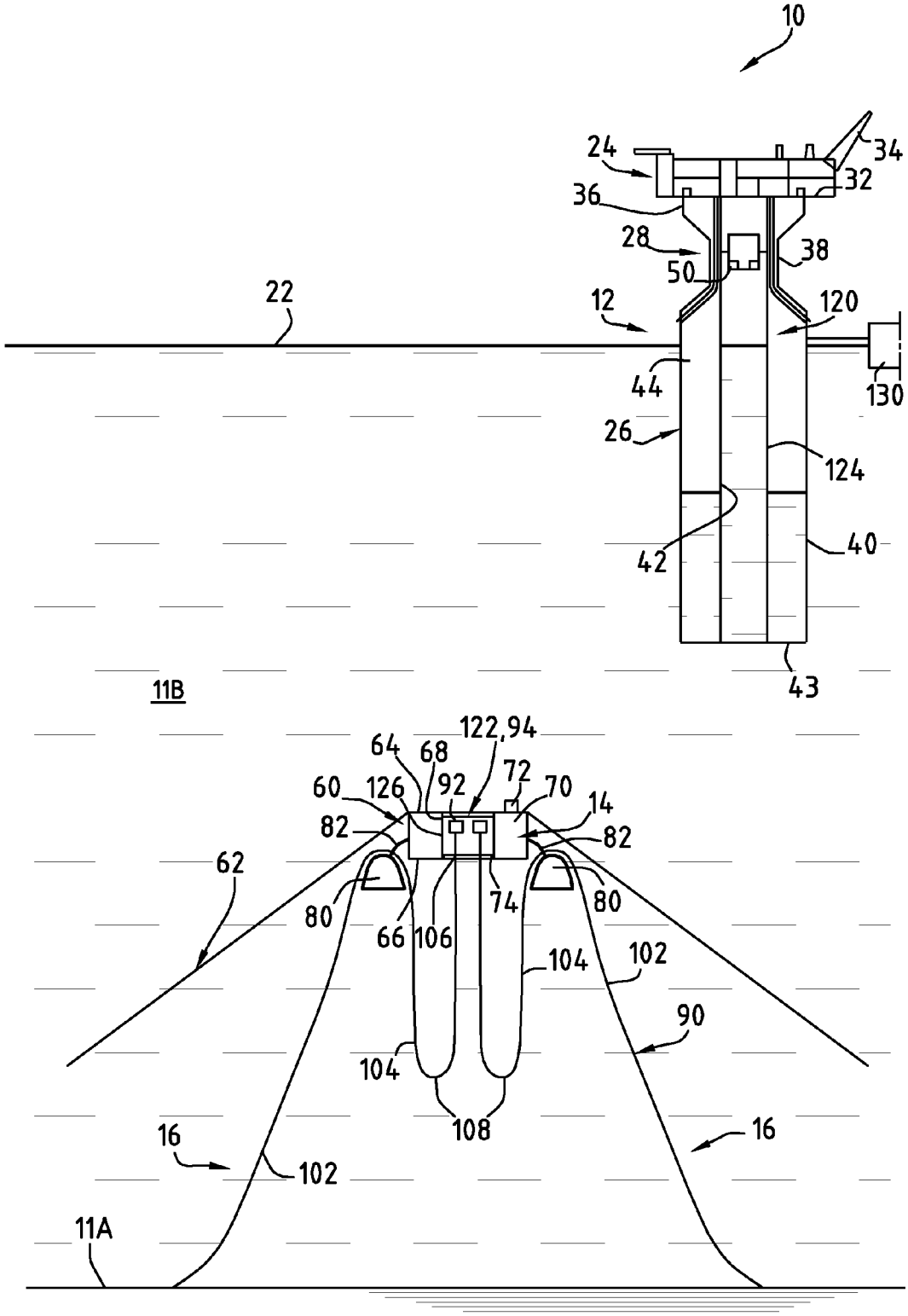
FIG. 4 is a view similar to FIG. 2, illustrating the movement of the upper structure of the installation of FIGS. 1 and 2 to an evacuation position.

As mentioned hereinbefore, the upper structure 12 is capable of moving transversely to the lower structure 14 between an extraction position disposed opposite the lower structure 14, shown in FIG. 1, and an evacuation position at a distance from the structure 14, shown in FIG. 4.

In the extraction position, the upper structure 12 is disposed on the base 60. The fixing means 72 are activated, and the upper anchor lines 30 keep the upper structure 12 completely immobile.

The upper central travel passage 42 opens opposite the lower central travel passage 68, defining a continuous passage extending between the connection station 28 and the lower surface 66 of the base 60.

In the evacuation position, the upper structure 12 has been moved completely away from the lower structure 14, outside the vertically delimited volume above the upper surface 64 of the structure 14. The upper surface 64 is disposed at a distance from the lower surface 43. The fixing means 72 are released. The upper central passage 42 extends transversely at a distance from the lower central passage 68.

The shaping means 20 comprise, for each flexible hose 16, an arch 80 disposed below the base 60 in the vicinity of the peripheral surface thereof.

In the example shown in FIG. 1, each arch 80 is carried by the base 60 while being connected to the base 60 by a linking arm 82 fixed to the base 60. Each arch 80 has an upper, upwardly convex surface for supporting a flexible hose 16.

To simplify the drawings, only two flexible hoses 16 are shown in FIGS. 1 to 4. However, the number of flexible hoses 16 may be greater than 2, for example between 2 and 50.

In this example, each flexible hose 16 comprises a fluid-conveying riser 90 and a connection head 92 disposed at the upper end of the riser 90.

The term "flexible hoses" denotes those described in the prescriptive documents published by the American Petroleum Institute (API), API 17J and API RP 17B, and well known to the person skilled in the art. This definition covers both unbonded and bonded flexible hoses.

More generally, and in a variation, some flexible hoses 16 may be a composite bundle, a set of umbilicals or electrical or optical cables disposed in a tubular sheath and capable of conveying a fluid, electric or hydraulic power or information between the bottom 11A of the expanse of water 11B and the surface installation 24. In the present application, the term "flexible hose" covers, in particular, the subsea umbilicals described in the prescriptive document API 17 E "Specification for Subsea Umbilicals" published by the American Petroleum Institute.

In a known manner, the head 92 comprises a connector for connecting to a collector 50 of the station 28 and a gate valve for preventing the penetration of liquids into the hose 90 when this hose 90 is immersed.

In the example shown in FIGS. 1 to 4, the heads 92 of the flexible hoses 16 are fitted integrally with a line stop 94 so as to be moved together.

Each hose 16 comprises a lower run 100 disposed on the bottom 11A, or buried at a shallow depth below the bottom 11A of the expanse of water 11B so as to be connected to a well head (not shown), a rising run 102 extending between the bottom 11A of the expanse of water 11B and the arch 80, a wave-shaped or S-shaped run 104 extending round the arch 80 to the lower structure 14 and an upper run 106 extending through the lower structure 14 and being capable of extending through the upper structure 12.

Each flexible hose 16 can therefore be moved relative to the structures 12, 14, between an upper configuration connected to a collector 50 of the connection station 28 and a lower disconnected configuration, shown in FIG. 4, in which each head 92 rests against the retaining stop 74 of the lower structure.

In the connection configuration shown in FIG. 1, the line stop 94 is disposed in the vicinity of the connection station 28. Each head 92 is connected to a collector 50 associated with the station 28.

In this configuration, the upper run 106 of each flexible hose 16 has a maximum length. It extends through the central passage 68 of the lower structure 14 and the central passage 42 of the upper structure 12, parallel to the axis X-X'. The length of the wave-shaped run 104 is therefore minimal.

In the lower disconnected configuration, shown in FIG. 4, the line stop 94 and each connection head 92 is disposed in the central passage 68 of the lower structure 14, at a distance from the central passage 42 of the upper structure 12 below the lower structure.

The length of the upper run 106 is minimal and the length of the wave-shaped run 104 is maximal.

However, the distance separating the lower surface 66 of the base 60 from the bottom 11A of the expanse of water 11B is selected so that the lowest point 108 of the wave-shaped run 106 is disposed at a distance from the bottom 11A of the expanse of water 11B, limiting the risk of damage to the hose 16.

The guide means 18 comprise a tubular guide 120 extending between the connection station 28 and the retaining stop 74 located on the lower structure 14, and a guided member 122 mounted so as to slide in the tubular guide 120.

In this example, the guided member 122 is formed by the line stop 94.

The tubular guide 120 comprises a tube which is common to all the flexible hoses 16. The tube comprises an upper portion 124 integral with the upper structure 12 and a lower portion 126 integral with the lower structure 14.

The upper portion 124 of the common tube delimits the upper central passage 42 and the lower portion 126 delimits the lower central passage 68.

In its upper portion 124 and in its lower portion 126, the tubular guide 120 has a section similar to the peripheral horizontal section of the line stop 94.

In the vicinity of the retaining stop 74, the lower portion 126 has a region with a cross-section, taken perpendicularly to the axis X-X', which is smaller than the cross-section of an upper region of the tube, and this forms a means for braking the line stop 94 in the guide 120.

The line stop 94 is thus mounted so as to slide in the guide 120 when each flexible hose 16 passes from its connected configuration to its disconnected configuration.

Operation of the first installation 10 according to the invention will now be described.

Initially, under normal extraction conditions, the upper structure 12 is held in its extraction position placed opposite the lower structure 14.

In this position, the upper surface 64 of the base 60 is applied to the lower surface 43 of the column 26 and the releasable fixing means 72 are activated.

As described hereinbefore, the upper anchor lines 30 keep the upper structure 12 completely immobile in this position.

Further, the flexible hoses 16 occupy their configuration connected to the station 28.

The line heads 92 are connected to the collectors 50. Fluid can thus be conveyed in the riser 90 from the bottom 11A of the expanse of water, through the rising run 102, the wave-shaped run 104 and the upper run 106 disposed in the central passage 68 of the lower structure 14 and in the central passage 42 of the upper structure 12. The length of the run 106 is maximal.

If a significant layer of ice begins to form on the surface 22 of the expanse of water 11B, the upper structure 12 can be moved vertically due to modification of its buoyancy in the caissons 44, as described hereinbefore.

However, if conditions necessitating a movement of the upper structure 12 towards its evacuation position are produced, for example if an iceberg heads for the structure 12, the upper structure 12 is evacuated.

The connecting heads 92 of each flexible hose 16 are accordingly separated from the collectors 50 on the installation 28, and the line stop 94 is released from the station 28.

Under the influence of gravity, the line stop 94 descends together with the heads 92 in the tubular guide 120 through the central passage of the upper structure 12 and through the central passage 68 of the structure 94, along the axis X-X'. The hose 16 therefore travels downwards through the passages 42, 68.

In the example shown in FIGS. 1 to 4, the heads 92 and the line stop 94 fall substantially freely in the guide 120, without being retained by a retaining member located above the line stop 94, for example the winch 51.

In a variation, the descent of the line stop 94 and each head 92 is controlled by the winch 51.

When the line stop 94 reaches the lower portion 126 of the tubular guide 120, and especially the region of reduced section, it is partially braked by the piston effect produced between the periphery of the line stop 94 and the internal surface of the tube, which limits the flow of liquid round the line stop 94.

This deceleration limits the risk of damage to the lower structure 14 when the line stop 94 reaches the retaining stop 74.

During this descent, the length of the upper run 106 decreases with the descent whereas the length of the wave-shaped run 104, taken along the hose 90, increases accordingly.

The line stop 94 thus reaches the retaining stop 74 and thus immobilizes itself against this retaining stop 74. This prevents the downward movement of each hose 16.

Each head 92 of a flexible hose 16 is thus retained in the lower structure 14 at a distance from the bottom 11A of the expanse of water in the central passage 68.

Further, the wave-shaped run 104 is held with its lowest point 108 at a distance from the bottom 11A of the expanse of water.

The releasable fixing means 72 are thus released to disconnect the upper structure 12 from the lower structure 14. The upper anchor lines 30 are also released, for example by raising the anchor lines 30 on the structure 12 or by isolating these lines 30.

A towing vessel 130 is then brought into the vicinity of the upper structure 12 to tow it away from the lower structure 14 and bring it safely towards an evacuation position, as illustrated in FIG. 4. Alternatively, the upper structure 12 may be provided with its own means of propulsion.

However, the head 92 of each hose 16 is held immobilized in position in the lower structure 14, at a distance from the bottom of the expanse of water 11B, so that it can very easily be found again when it is necessary to reconnect the installation 10.

Once the emergency situation is over, the upper structure 12 is brought back into its extraction position, opposite the lower structure 14, and is connected to this structure by the fixing means 72.

The winch 51 present in the station 28 is then used to raise the line stop 94 and each head 92 through the central passage 68 of the lower structure and the central passage 42 of the upper structure, up to the connection station 28.

The disconnection, as well as the subsequent connection of the flexible hoses 16 from/to the connection station 28 can thus be carried out very easily and very quickly, and this limits the time when the extraction installation 10 cannot be used for fluid extraction.

In a first variation, shown in broken lines in FIG. 1, the flexible hose 16 assumes a catenary shape in the form of a J between the bottom 11A of the expanse of water and the lower structure 14. Therefore the line 16 is free from a wave-shaped run 104, so the rising run 102 extends to the central passage 68.

Operation of this variation of the installation is similar to that of the first installation 10.

Figure 8:
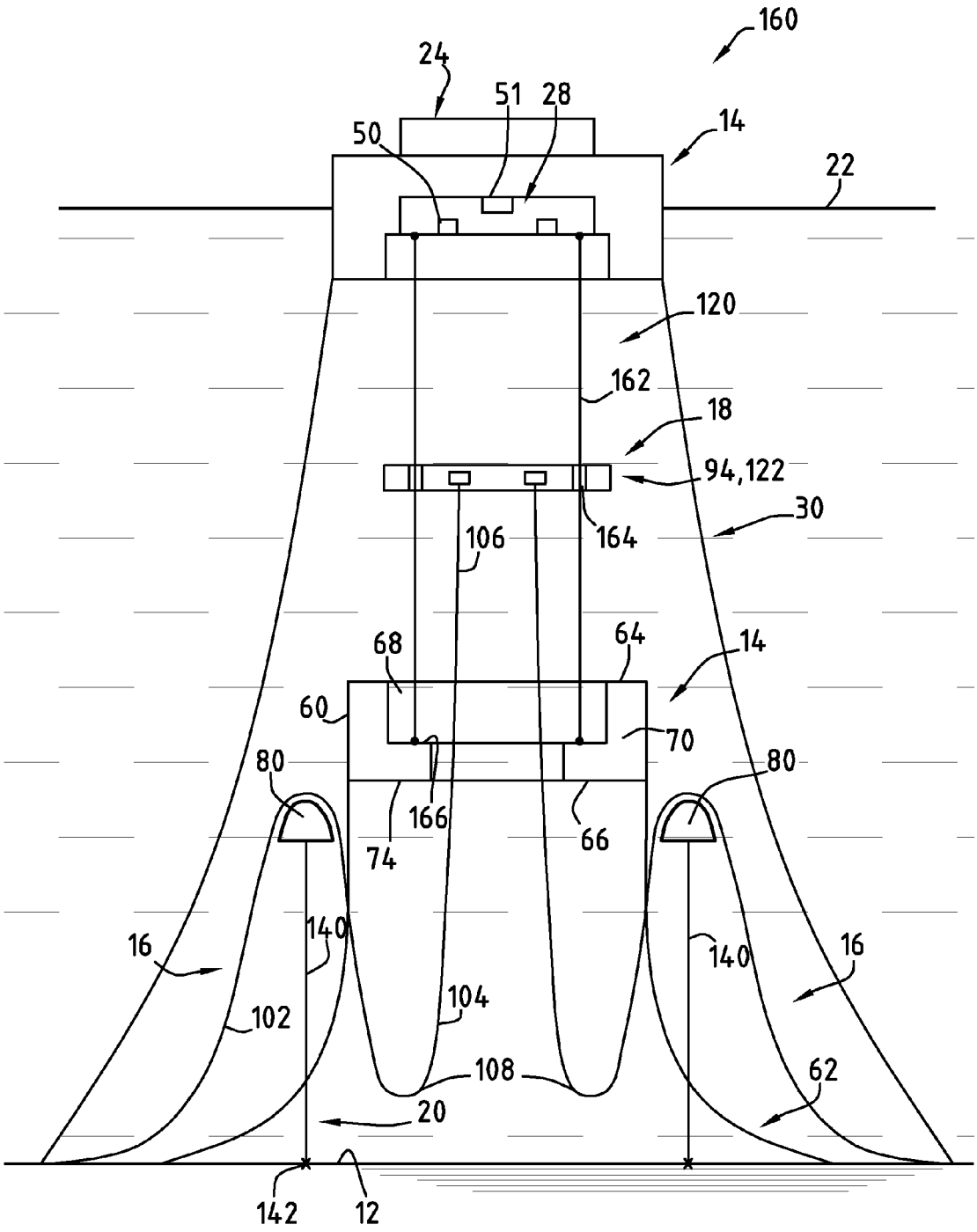
FIG. 8 is a view similar to FIG. 1 of a third installation according to the invention.

In a further variation, the shaping means 20 are disconnected from the lower structure 14. Accordingly, and as illustrated by FIG. 8, these means 20 comprise an arch 80 including a floating buoy and an anchor cable 140 connecting the arch 80 to the bottom 11A of the expanse of water. The cable 140 is equipped, at its lower end, with means 142 for anchoring at the bottom 11A of the expanse of water 11B. The hose 16 thus adopts what is known as a lazy S configuration.

In a further variation (not shown), the shaping means 20 consist of a number of annular buoys surrounding and supporting the hose 16 at the upper portion of the wave. These shaping means 20 are thus disconnected from both the structure 14 and the bottom 11A, while being free from means 142 for anchoring on the bottom 11A. The hose 90 thus adopts what is known as a lazy wave configuration. The buoyancy is generally distributed over a relatively great length, in practice of at least several tens of meters, with the result that the lazy wave configuration is less compact than the lazy S configuration. However, it has the advantage of being much easier to install.

Figure 5:
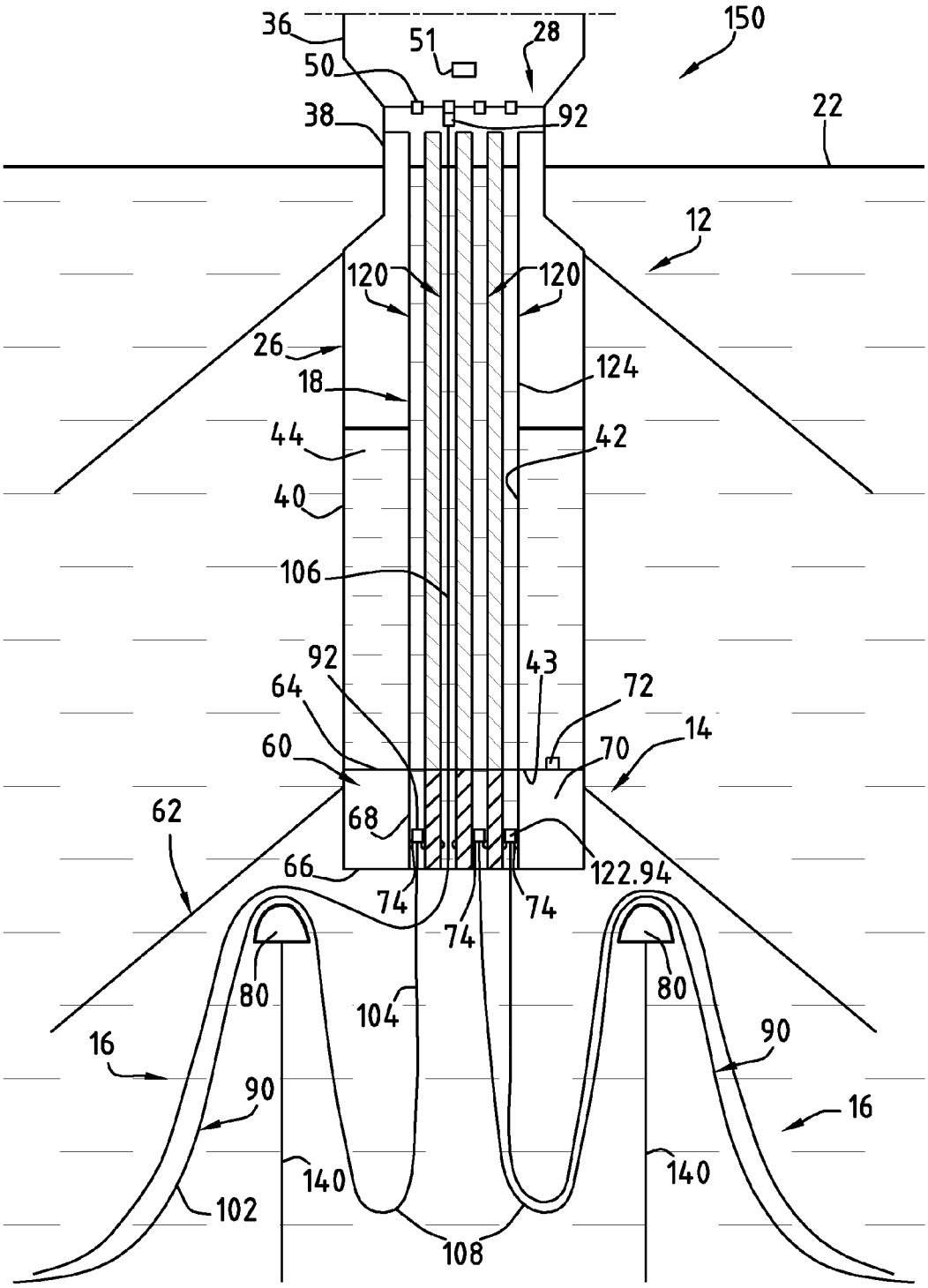
FIG. 5 is a view similar to FIG. 1 of a second extraction installation according to the invention.

A second installation 150 according to the invention is shown in FIG. 5.

The second installation 150 differs from the first installation 10 in that each hose 16 can be moved individually between its connected configuration and its disconnected configuration, the line heads 92 being independent of one another.

Figure 7:
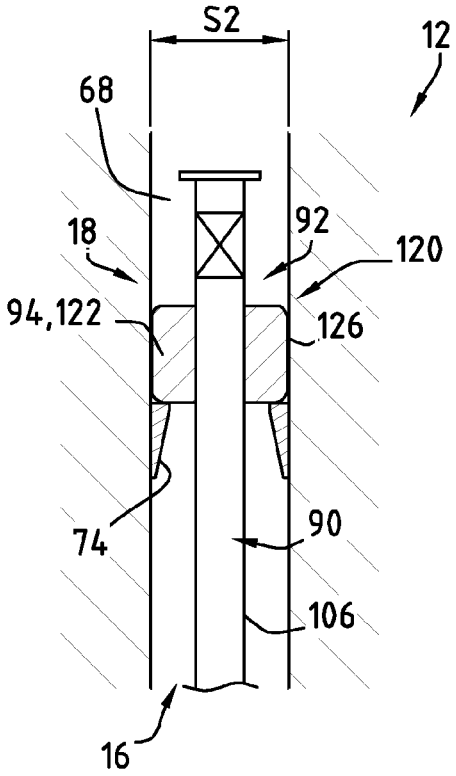
FIG. 7 is a view similar to FIG. 6, showing a flexible hose abutting in the lower structure.

The guide means 18 thus comprise, for each line 16, an individual tubular guide 120 receiving exclusively a line 16 and an individual line stop 94 for cooperating with an associated retaining stop 74 projecting radially into each tubular guide 120, as illustrated in FIG. 7.

Figure 6:
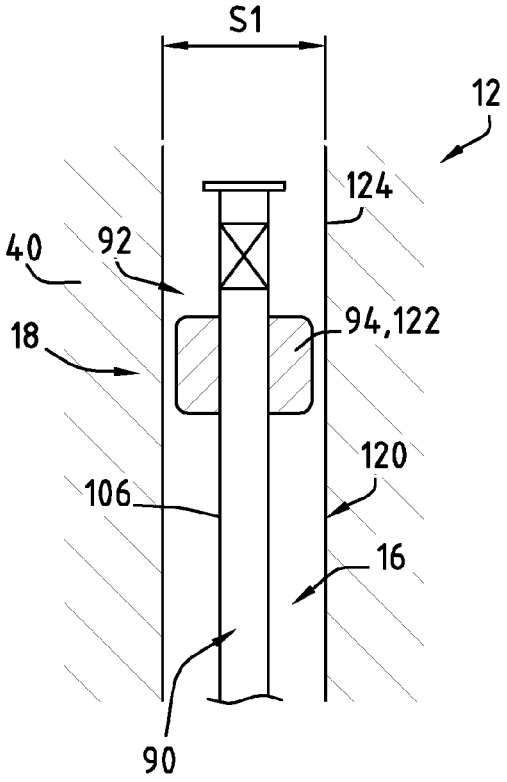
FIG. 6 shows a detail of the installation of FIG. 5 during the descent of a flexible hose in a guide tube.

Referring to FIGS. 6 and 7, and as described hereinbefore, the section S2 of each tubular guide 120, in the vicinity of the lower retaining stop 74, is smaller than the section S1 of the guide 120 in an upper region to allow progressive braking of the line stop 94 before it makes contact with the retaining stop 74.

Operation of the second installation 150 differs from operation of the first installation 10 in that each flexible hose 16 has to be connected and disconnected individually from the station 28, and passes between its upper connected configuration and its lower disconnected configuration, independently of the other hoses 16.

FIG. 8 shows a third installation 160 according to the invention. This third installation 160 differs from the first installation 10 in that, in the extraction position, the upper structure 12 is disposed opposite and at a distance from the lower structure 14, above this structure 14.

The guide 120 of the guide means is formed by cables 162 connecting the connection station 28 on the upper structure 12 to the lower structure 14.

The cables 162 are disposed substantially parallel to the vertical axis X-X'.

The line stop 94 includes, for each cable 162, a vertical through-aperture 164 which receives the cable 162 in a sliding manner. The aperture 164 opens upwards and downwards so that the line stop 94 is mounted so as to slide round each cable 162 along the axis X-X'.

The retaining stop 74 on the lower structure 14 is formed by a shoulder 166 which projects into the central passage 68 of the lower structure 14.

The upper structure 12 and the lower structure 14 are connected exclusively by the cables 162. Therefore, it is very easy to disconnect the upper structure 12 at a distance from the lower structure 14, while allowing adequate guidance of the line stop 94 as it moves between the upper connected configuration of the line 16 and the lower disconnected configuration, abutting against the lower structure 14.

In a variation of the third installation 150, the installation 160 is free from guide means 18 for the line stop 94. The line stop 94 therefore falls freely, without guidance towards the lower structure 14.

Figure 9:
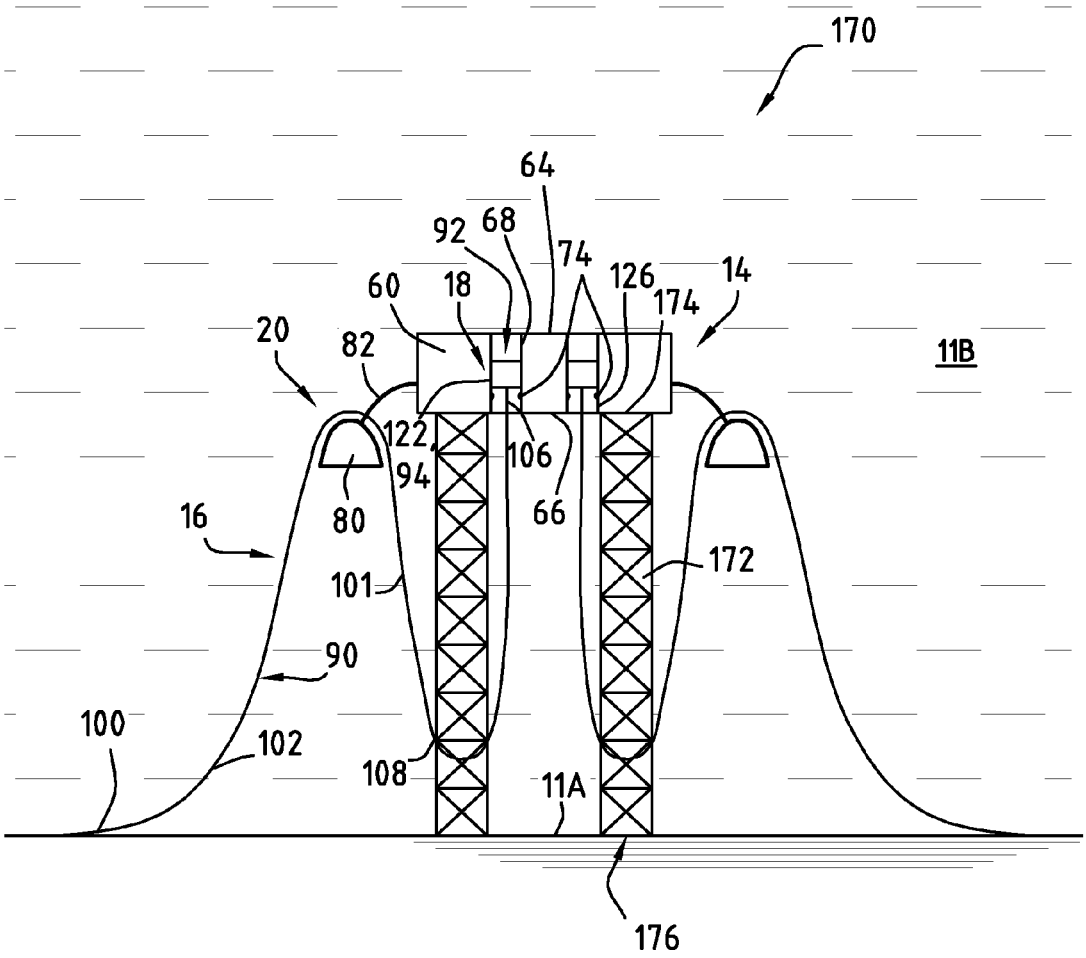
FIG. 9 is a view similar to FIG. 1 of a fourth installation according to the invention.

The fourth installation 170 according to the invention, shown in FIG. 9, differs from the installations 10, 150, 160 in that the lower structure 14 is rigidly fixed on the bottom of the expanse of water by means of substantially vertical rigid legs 172. The base 60 is thus free from flotation means.

Each leg 172 extends between an upper end 174 fixed below the base 60 and a lower end 176 fixed in the subsea bottom 11A.

Operation of the fourth installation 160 according to the invention is similar to that of the other installations.

In a further more general variation, the installations are free from a lower structure 14, the central passage 42 opening opposite a volume of water released to the bottom 11A of the expanse of water.

As mentioned above, the invention is advantageously carried out with the upper structure 12 and the lower structure 14 forming two portions of a floating platform of the "rising column" type, which is partially immersed in the expanse of water 11B, commonly known by the acronym SPAR.

Accordingly, the height of column 26 is advantageously higher than 150 m. The ratio of the height of column 26, taken vertically along the X-X' axis, to the maximum transverse dimension of the immersed lower portion 36, taken perpendicularly to the X-X' axis, is higher than 3 and is in particular equal to approximately 4. The transverse dimension of the immersed lower portion 36 is approximately constant along its height, and is for example lower than 60 m.

The height of column 26, taken along the X-X' axis, is higher than 3 times, advantageously higher than 4 times, the height of base 60.

Column 26 advantageously carries a fixed ballast in a "soft part" at the bottom of its immersed lower portion 36, below the flotation compartments 44, in the vicinity of the lower surface 43. It may also comprise a structural mid-section separating the "soft part" from the "hard tank" containing the flotation compartments 44.

In an embodiment, referred to as "classic spar", the column 26 comprises a single cylindrical continuous external tube delimiting externally the hard tank, the structural mid-section and the soft tank.

In a variation referred to as "truss spar", the column 26 comprises a cylindrical tubular hard tank, and a truss mid-section made of a lattice of structural beams attached together, with intermediate heave plates. An example of "truss spar" is disclosed in U.S. Pat. No. 5,558,467.

In another variation, referred to as "cell spar", the column 26 comprises an assembly of parallel vertical tubes joined together and extending from the top surface of column 26 to the bottom surface 43 of column 26. In that case, the base 60 is advantageously made of a corresponding assembly of tubes, each tube of column 26 being in register with a tube of base 60 in the extraction position. An example of "cell spar" is disclosed in U.S. Pat. No. 6,817,309.

What is claimed is:

1. Installation for the extraction of fluid from an expanse of water, comprising:

an upper structure extending at least in part above the surface of the expanse of water;

at least one flexible hose extending through the expanse of water, the flexible hose comprising a connection head for connection to a collector placed on the upper structure, the flexible hose being capable of moving through the expanse of water between an upper configuration in which it is connected to the collector and a lower disconnected configuration;

wherein the installation comprises:

a lower structure which is completely immersed in the expanse of water and has a base extending at a distance from the bottom of the expanse of water and an arrangement to hold the base in position relative to the bottom of the expanse of water, the upper structure being capable of moving relative to the lower structure between an extraction position located substantially opposite and above the lower structure and an evacuation position located at a distance from the lower structure, the base defining for the at least one flexible hose:

at least a passage for the travel of the flexible hose as it moves between the upper connected configuration and the lower disconnected configuration at least a stop for retaining the connection head, the stop being disposed in the travel passage, to hold the connection head at a distance from the bottom of the expanse of water in the lower disconnected configuration, wherein the base defines an upper surface for securing the upper structure, the upper surface being placed at a depth greater than 150 m at least in the extraction position and in the evacuation position, wherein in the extraction position, the upper structure has a lower surface, which is supported on the upper surface of the lower structure at a depth greater than 150m.

2. Installation according to claim 1, wherein the base floats above the bottom of the expanse of water at least when the upper structure occupies its evacuation position and when the flexible hose occupies its lower disconnected configuration.

3. Installation according to claim 1, wherein the base is mounted in a rigidly fixed manner on the bottom of the expanse of water by means of at least one rigid fixing element placed on the bottom of the expanse of water.

4. Installation according to claim 1, further comprising a plurality of flexible hoses, the base defining, for each flexible hose, an individual passage for the travel of the flexible hose receiving a single flexible hose, the flexible hoses being capable of moving independently of one another between the upper connected configuration and the lower disconnected configuration.

5. Installation according to claim 1, further comprising a plurality of flexible hoses, each flexible hose having a connection head for connection to a collector placed on the upper structure, the installation comprising a common member for linking the connection heads of each flexible hose to jointly move the connection heads of each flexible hose as each flexible hose passes between the upper connected configuration and the lower disconnected configuration.

6. Installation according to claim 1, further comprising a guide arrangement to guide the flexible hose between its upper connected configuration and its lower disconnected configuration, the guide arrangement extending between a first point located on the upper structure and a second point located on the lower structure when the upper structure occupies its extraction position.

7. Installation according to claim 6, wherein the guide arrangement comprise a guide integral with the lower structure and the upper structure and a guided member integral with the flexible hose, the guided member being mounted so as to slide relative to the guide as the flexible hose passes between the upper connected configuration and the lower disconnected configuration.

8. Installation according to claim 7, wherein the guide comprises a guide tube which includes an upper portion integral with the upper structure and a lower portion integral with the lower structure, the guided member being mounted so as to slide in the guide tube.

9. Installation according to claim 8, wherein the guide tube has an upper region at a distance from the retaining stop, the upper region having a first cross-section, and in that the guide tube has a lower region located in the vicinity of the retaining stop and having a second cross-section smaller than the first cross-section.

10. Installation according to claim 7, wherein the guide comprises at least a guide line integral with the upper structure and with the lower structure, the guided member being mounted so as to slide round the guide line.

11. Installation according to claim 1, wherein the or each collector is permanently disposed in a delimited volume of gas on the upper structure when the upper structure occupies its extraction position, the retaining stop being disposed in a volume of liquid immersed in the expanse of water.

12. Installation according to claim 1, wherein it comprises at least one arch disposed in the vicinity of the lower structure, the flexible hose being engaged over the arch so as to have a wave-shaped run at one outlet of the travel passage.

13. Installation according to claim 12, wherein the arch is carried by the lower structure.

14. Installation according to claim 12, wherein the arch is independent of the lower structure, the arch comprising a buoy and means for anchoring the buoy at the bottom of the expanse of water.

15. Installation according to claim 1, wherein the upper structure comprises a surface installation and a floating column having a generally tubular shape disposed below the surface installation and partially immersed in the expanse of water.

16. Installation according to claim 15, wherein the floating column has an upper portion disposed above the surface of the expanse of water and a lower portion immersed below the expanse of water, the height of the immersed lower portion being at least twice as great as the height of the upper portion.

17. Installation according to claim 16, wherein the floating column further delimits, in the lower portion a plurality of flotation compartments capable of being filled selectively with water or gas, to control the buoyancy of the upper structure.

18. Method for disconnecting an installation for the extraction of fluid, wherein it comprises the following steps:

holding an extraction installation according to claim 1 in an expanse of water, the flexible hose being disposed, in its upper connected configuration, on the collector integral with the upper structure, the upper structure occupying its extraction position;

disconnecting the connection head of the flexible hose, at a distance from the collector;

passing the flexible hose from its upper connection configuration to its lower disconnected configuration, the flexible hose traveling through the travel passage in the lower structure;

immobilizing the connection head against the receiving stop to immobilize the connection head on the lower structure at a distance from the bottom of the expanse of water;

moving the upper structure relative to the lower structure from its extraction position to its evacuation position.

19. Installation according to claim 1, wherein the at least one flexible hose is able to travel through the upper structure over more than 150 meters between the upper connected configuration and the lower disconnected configuration.

20. Installation according to claim 1, wherein, in the upper configuration, the flexible hose is connected to a collector located above the surface of the water.

21. Installation for the extraction of fluid from an expanse of water, comprising:

an upper structure extending at least in part above the surface of the expanse of water;

at least one flexible hose extending through the expanse of water, the flexible hose comprising a connection head for connection to a collector placed on the upper structure, the flexible hose being capable of moving through the expanse of water between an upper configuration in which it is connected to the collector and a lower disconnected configuration;

wherein the installation comprises:

a lower structure which is completely immersed in the expanse of water and has a base extending at a distance from the bottom of the expanse of water and an arrangement to hold the base in position relative to the bottom of the expanse of water, the upper structure being capable of moving relative to the lower structure between an extraction position located substantially opposite and above the lower structure and an evacuation position located at a distance from the lower structure, the base defining for the at least one flexible hose:

at least a passage for the travel of the flexible hose as it moves between the upper connected configuration and the lower disconnected configuration at least a stop for retaining a connection head, the stop being disposed in the travel passage, to hold the connection head at a distance from the bottom of the expanse of water in the lower disconnected configuration; and a guide arrangement to guide the at least one flexible hose between its upper connected configuration and its lower disconnected configuration, the guide arrangement extending between a first point located on the upper structure and a second point located on the lower structure when the upper structure occupies its extraction position, wherein the guide arrangement comprises a guide integral with the lower structure and the upper structure in the extraction position and the evacuation position and a guided member integral with the flexible hose, the guided member being able to slide relative to the guide as the flexible hose passes between the upper connected configuration and the lower disconnected configuration, wherein the guide comprises a guide tube, which includes an upper portion integral with the upper structure and a lower portion integral with the lower structure, and wherein the guided member is movable jointly with the flexible hose by sliding in the guide tube.

22. Installation according to claim 21, wherein the flexible hose is able to travel through the upper structure over more than 150 meters between the upper connected configuration and the lower disconnected configuration.

23. Installation according to claim 21, wherein, in the upper connected configuration, the flexible hose is connected to a collector located above the surface of the water.

* * * * *